US006612052B2

(12) United States Patent
Sawchuk

(10) Patent No.: US 6,612,052 B2
(45) Date of Patent: Sep. 2, 2003

(54) DISPLAY DEVICE

(76) Inventor: Beth A. Sawchuk, 1042 Summitview Pl., Bloomington, IN (US) 47401

( * ) Notice: Subject to any disclaimer, the term of this patent is extended or adjusted under 35 U.S.C. 154(b) by 10 days.

(21) Appl. No.: 09/920,561

(22) Filed: Aug. 1, 2001

(65) Prior Publication Data

US 2003/0024141 A1 Feb. 6, 2003

(51) Int. Cl.[7] ..... G09F 1/00
(52) U.S. Cl. ..... 40/124.01; 40/124.2
(58) Field of Search ..... 40/124, 124.2, 40/124.01, 124.16, 124.09, 672, 124.14

(56) References Cited

U.S. PATENT DOCUMENTS

| | | | | |
|---|---|---|---|---|
| 4,245,414 A | * | 1/1981 | Shypula | 40/124 |
| 4,905,845 A | | 3/1990 | Broeker et al. | |
| 4,949,849 A | | 8/1990 | Hardy et al. | |
| 4,976,359 A | | 12/1990 | Hardy et al. | |
| 5,720,396 A | | 2/1998 | Wegscheid et al. | |
| 5,915,571 A | | 6/1999 | Czalkiewicz et al. | |

OTHER PUBLICATIONS

Four (4) Samples and Models of Pocket Identifiers believed to have been used or sold prior to Aug. 1, 2001.

* cited by examiner

*Primary Examiner*—Gary Hoge
(74) *Attorney, Agent, or Firm*—Fish & Richardson P.C.

(57) ABSTRACT

In one aspect, the present invention is directed to an improved display device that accommodates articles or display receptacles having a plurality of different dimensions. In a preferred embodiment, the display device includes a product identifier ("PID") card having a plurality of folds and at least one pre-cut area. The folds and pre-cut area can be manipulated to provide a booster for short greeting cards. The folds can also be manipulated to convert the display article for use in connection with spinner-type display units. The PID of a preferred embodiment can include a vertically disposed label area that remains unobstructed when tall cards are placed in or in front of the display device. In another aspect, the invention relates to a display device having a non-linear upper edge that can form a contiguous pattern in cooperation with adjacent display devices. In a preferred embodiment, the PID can further include a top edge having an arcuate or other patterned configuration, wherein the edge forms a continuous pattern when multiple PIDs are installed adjacent one another.

24 Claims, 7 Drawing Sheets

DISPLAY DEVICE

TECHNICAL FIELD

The present invention relates to the display or labeling of products. In a preferred embodiment, the invention relates to adjustable apparatus for use in connection with the retail display of greeting cards and the like.

BACKGROUND

Greeting cards are typically displayed in racks having one of two primary configurations. The first is a tiered display unit having parallel rows of pockets or channels into which greeting cards are placed. The channels can have a depth less than the height of the cards to be displayed therein, thereby enabling prospective customers to view a substantial portion of the top of each card. The second primary type of display is known as a "spinner." Spinners are cylindrical, rotatably mounted display units having a plurality of card receptacles disposed around their periphery. In use, customers can rotate the spinner to bring additional receptacles into view.

The card receptacles in both the tiered and spinner display units are configured to fit a wide variety of different card sizes. Often, this is accomplished by providing display receptacles having dimensions at least as great as the largest card to be displayed. Even when adjustable display units are employed, rows or columns of card receptacles typically have identical internal dimensions.

The variation in display configuration and card dimensions causes several problems. First, it is necessary to use a variety of different placards and labels for the different types of display units and the various card sizes. Second, smaller cards nest too far within the receptacle and must be raised upwards by a supplementary device in order to be seen properly. Third, the varying height of the cards often causes, in the case of tall cards, obstruction of the associated labels or tags. In the case of short cards, the variation in height creates an undesirable variation in the amount of distance between the tops of the cards and the associated labels or tags.

Known solutions to these problems are relatively complicated and expensive. For instance, separate cardboard "boosters" can be inserted into the card channel to raise short cards up to an appropriate viewing position. However, the provision, shipment and installation of separate boosters is both time-consuming and costly. It is also known to provide pocket identifier cards (PIDs) that are somewhat taller than the standard greeting card and contain a caption describing the type of card in that particular receptacle. The PID sits directly behind the greeting cards and bears a suitable label near its top, above the upper edge of the associated greeting cards. However, known PIDs often obstruct smaller cards in the row above and behind the PID. Moreover, tall cards block the caption on known PIDs, thereby necessitating the provision of PIDs having additional sizes, which in turn increases cost and creates a visually complex and confusing arrangement.

SUMMARY

In one aspect, the present invention is directed to an improved display device that accommodates articles or display receptacles having a plurality of different dimensions. In a preferred embodiment, the display device includes a pocket identifier card ("PID") having a plurality of folds and at least one pre-cut area. The folds and pre-cut area can be manipulated to provide a booster for short greeting cards. The folds can also be manipulated to convert the display article for use in connection with spinner-type display units. The PID of a preferred embodiment can include a vertically disposed label area that remains unobstructed when tall cards are placed in or in front of the display device.

In another aspect, the invention relates to a display device having non-linear upper edge that can form a contiguous pattern in cooperation with adjacent display devices. In a preferred embodiment, the PID can further include a top edge having an arcuate or other patterned configuration, wherein the edge forms a continuous pattern when multiple PIDs are installed adjacent one another.

The details of one or more embodiments of the invention are set forth in the description below. Other features, objects, and advantages of the invention will be apparent from the description, and from the claims.

BRIEF DESCRIPTION OF DRAWINGS

Like reference numbers and designations in the various drawings indicate like elements.

DETAILED DESCRIPTION OF THE PREFERRED EMBODIMENTS

Figure 1:
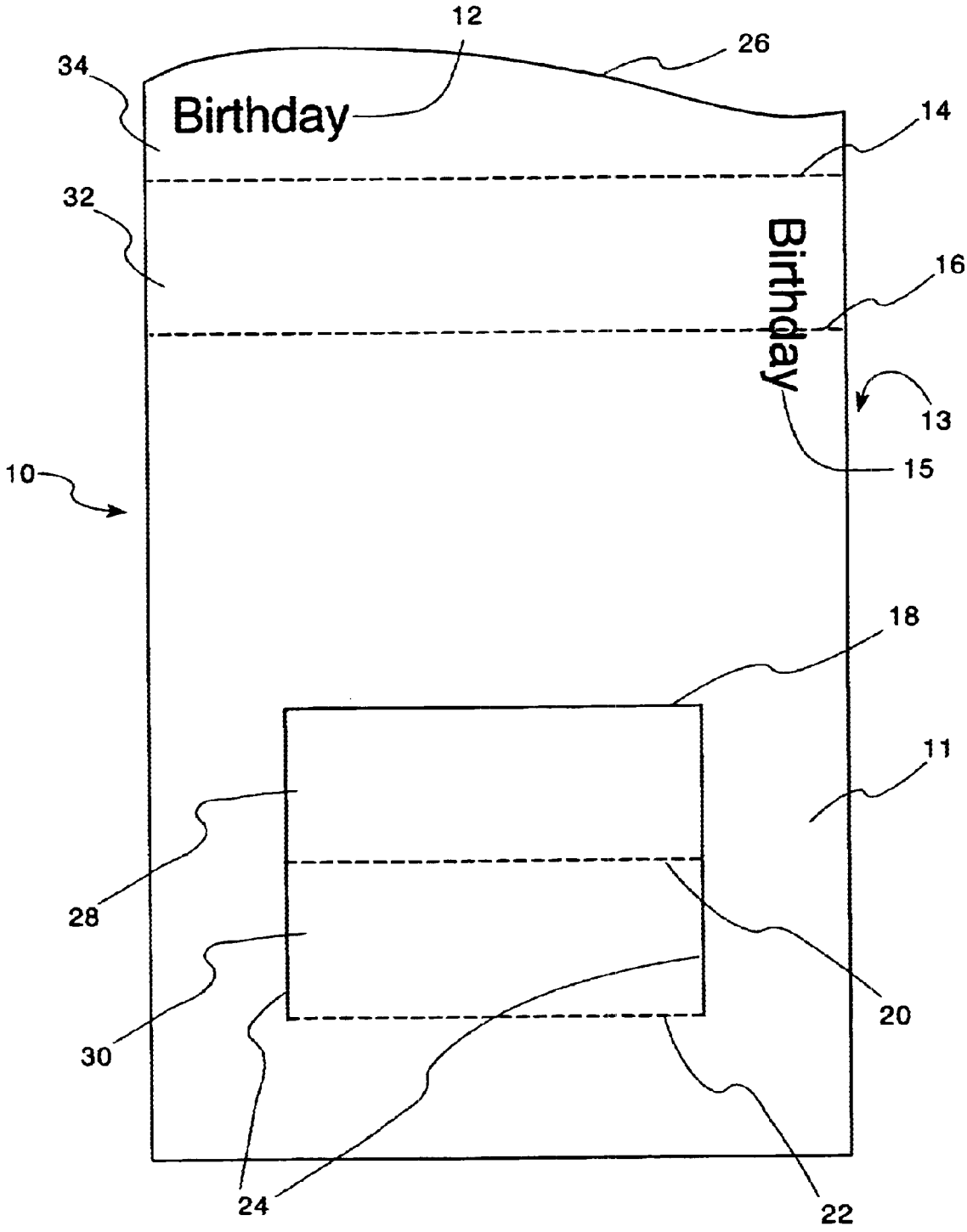
FIG. 1 is a front view of a PID.

FIG. 1 depicts one embodiment of a display device constructed in accordance with the present invention. The PID 10 is constructed of cardstock and has a front face 11, opposed rear face 13 and four lateral edges. The PID includes horizontal label area 12 and vertical label area 15, each of which portray information pertinent to the cards to be inserted in front of the PID. As used herein, the term "label" refers generically to indicia either affixed to or printed on the PID. The PID 10 further includes a booster flap area 28, 30 defined by die cuts 18 and 24. The booster flap area 28, 30 is scored along lines 20 and 22 to facilitate folding. The upper area of the PID is scored along lines 14 and 16 for the same reason. The upper edge 26 is provided with an arcuate contour that blends visually into adjacent PIDs having the same construction, as described in more detail below.

The configuration of the PID 10 can be modified to accommodate articles having a wide variety of different configurations. For instance, the score lines can be relocated, moved, or repeated along different portions of the PID to provide different folded configurations. The label regions 12 and 15 can be provided on the front or rear surface of the PID, as desired, and can be relocated to any relative position on the faces 11, 13 of the PID. The PID 10 can be die cut along virtually any contour to enable a portion of the PID to fold and accommodate or support different configurations of greeting cards. The die cut fold areas may optionally support a product in a lateral direction. Moreover, the utility of the PID 10 is limited to neither greeting cards nor retail display. Rather, the PID 10 can be advantageously implemented in connection with any other product that is to be displayed for viewing.

Figure 2:
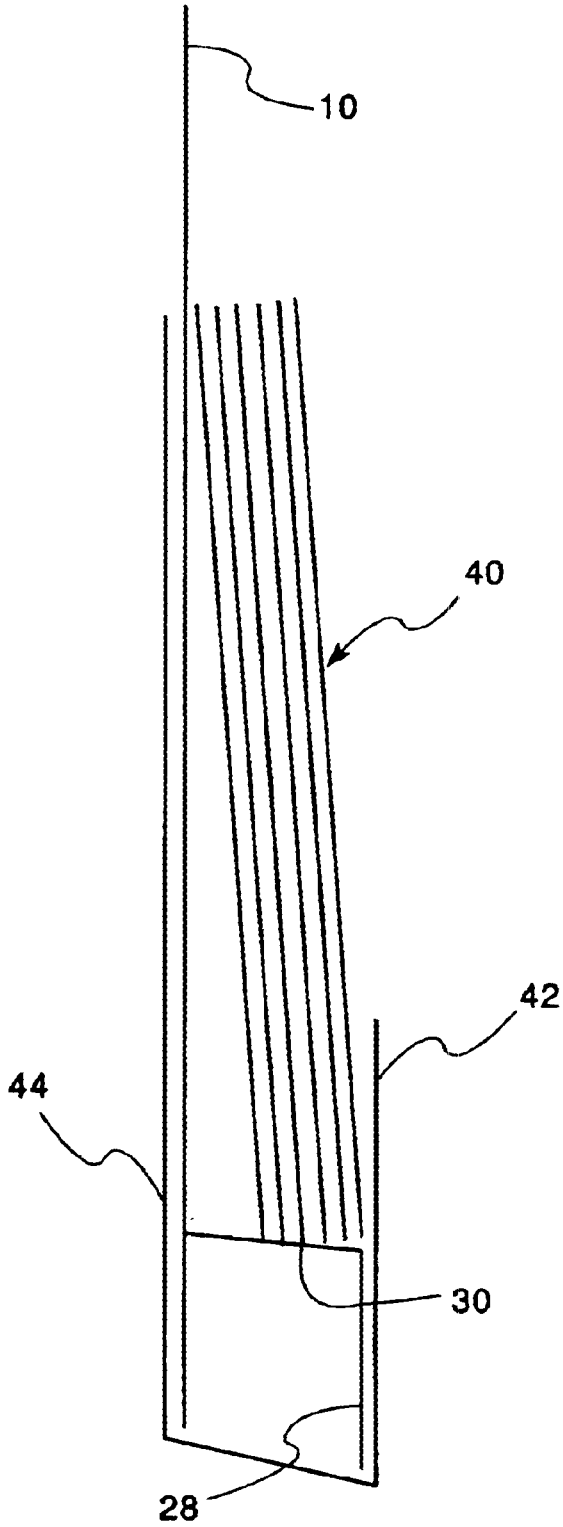
FIG. 2 is a side view of the PID of FIG. 1 installed in a display unit, the PID being configured to provide a booster for the greeting cards.

The PID 10 can be configured as shown in FIG. 2 to provide a booster for cards 40. The die cut flat area 28, 30 is folded forward and downward and then bent in a right angle at score line 20 such that flap area 30 is horizontal and flap area 28 is vertical. The edge of flap area 28 rests on the bottom of channel defined by walls 42 and 44 in a tiered display case. Optionally, the channel can be included in a spinner-type display case and be constructed of a transparent polymeric material. When cards 40 are inserted into the channel, the flap area 30 supports them, effectively raising them off the floor of the channel to an appropriate viewing position. The flap area 30 is advantageously disposed a slight incline, sloping upwards toward the rear of channel 44. The incline causes the bases of cards 40 to slide downward toward the front of the channel 42 which, in turn, causes the tops of the cards 40 to lean back toward the PID 10 to an optimal viewing angle. The incline can be created by a slope in the floor of the channel, by appropriate dimensioning of flap area 28, or by other suitable means.

Figure 5:
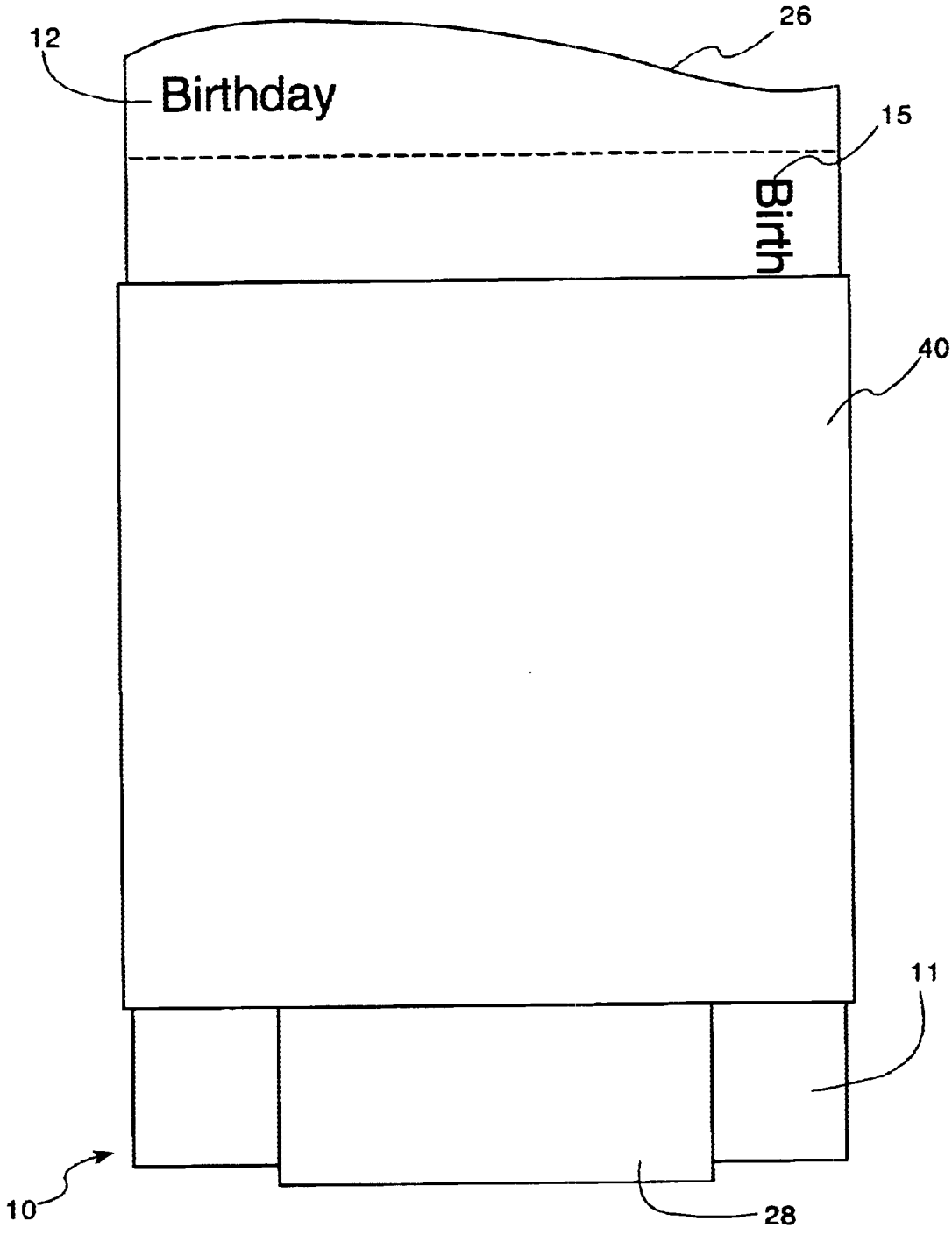
FIG. 5 is a front view of a short greeting card disposed in front of the PID of FIG. 1, a die-cut portion of the PID having been folded to provide a booster for the greeting card.

FIG. 5 is a front view of the cards and PID depicted in FIG. 2. The card 40 rests on the flap area 30 (not shown), which is in turn supported by flap area 30 the face 11 of the PID. The top of PID 10 projects above the cards 40 such that label 12 is plainly visible. Vertical label 15 can be relocated to a lower position on the PID such that no portion of it is visible when cards of a selected dimension are installed in the PID/channel assembly. The top of the PID 10 is provided with a wave-like edge that provides ample label area (around label 12) but increases the visibility of cards disposed rearwardly of PID 10. The pattern also cooperates with adjacent PIDs to provide a contiguous pattern that reduces visual clutter and aids in label recognition, as is described in further detail below.

Figure 3:
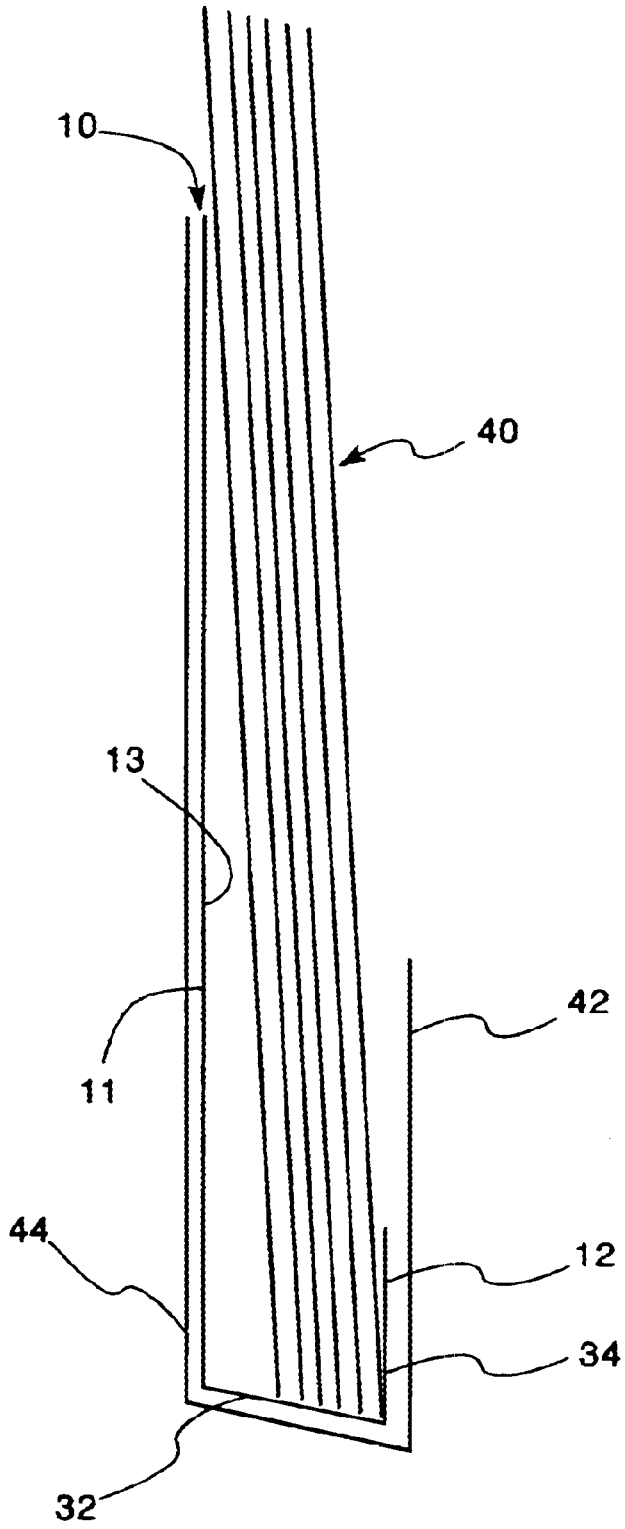
FIG. 3 is a side view of the PID of FIG. 1 installed in a display unit, the PID being configured to provide a visible caption or label at the base of the card.

FIG. 3 depicts a PID 10 installed in a transparent receptacle 42, 44 of a type commonly found on spinner-type display racks. Before installation into the receptacle, the PID 10 was folded along score lines 14, 16 (see FIG. 1) such that the label 12 and flap area 34 faced in the same direction as the rear face 13 of PID 10. The PID was rotated about the horizontal axis (in FIG. 1) and then inserted into the transparent receptacle 42, 44. Accordingly, the label 12 can be viewed through the front of the transparent receptacle 42. Advantageously, the flap area 32 is disposed at an incline relative to the rear face 13 of the PID 10 such that the cards 40 tilt backwards, as shown, for optimal viewing. Optionally, a die-cut flap arrangement to that depicted in FIGS. 2 and 5 may be used to provide an incline in situations where the bottom of receptacle lacks the desired incline. The top of PID 10 is flush with the back wall 44 of the receptacle, but PID 10 may optionally be configured such that the PID 10 projects above the cards 40. The top of flap area 34 is provided with a non-linear pattern, as shown in FIG. 1. Similar or identical patterns can advantageously be provided on the opposite end of PID 10, especially where the end projects above the cards 40 (embodiment not shown).

Figure 4:
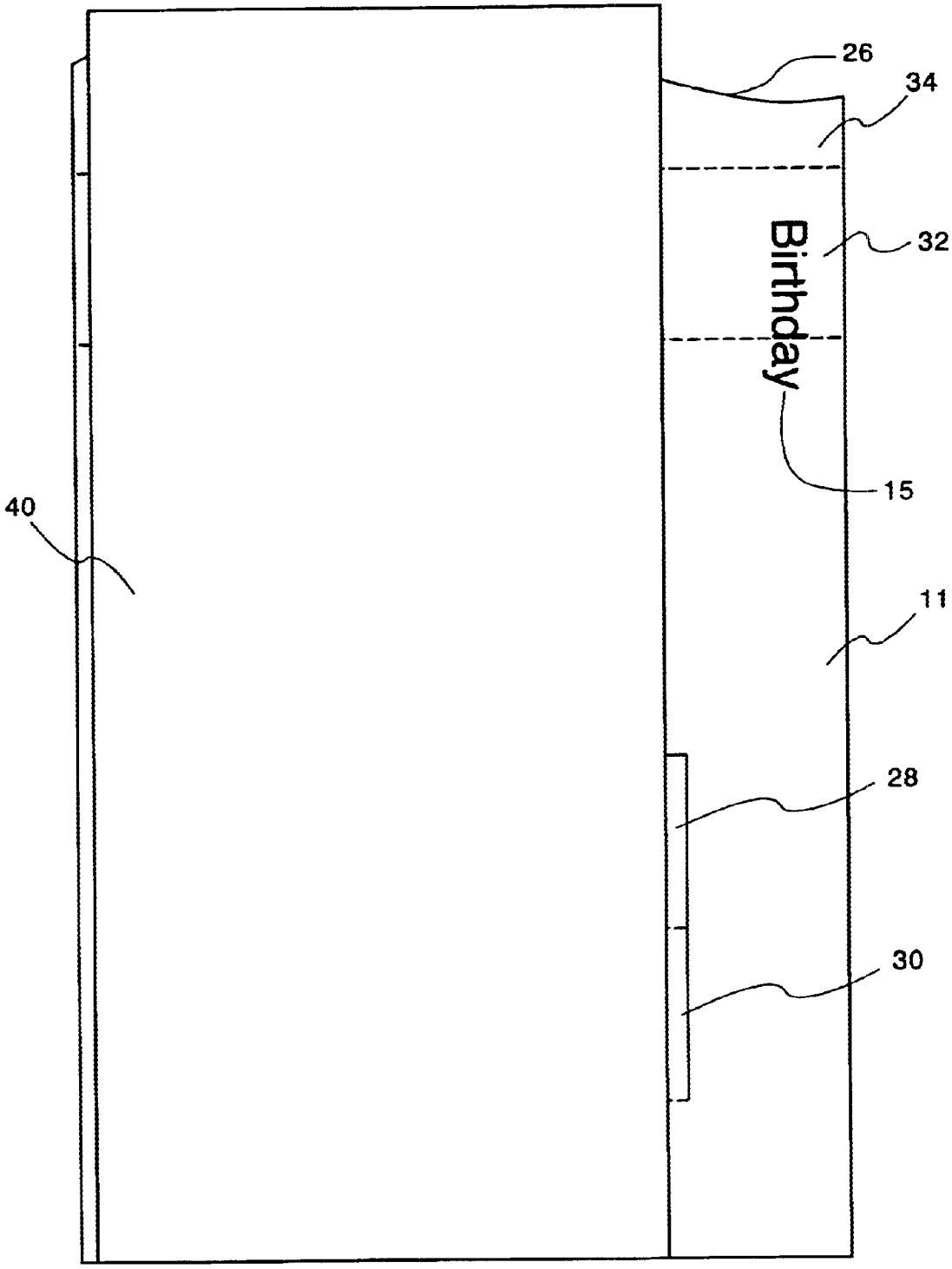
FIG. 4 is a front view of a tall greeting card disposed in front of the PID of FIG. 1.

FIG. 4 illustrates a utility of the vertically disposed labeling area 15. Tall and slender cards 40 may be installed adjacent to the PID 10 without blocking the labeling information. When the horizontal label area 12 is obstructed, the vertical label area 15 is visible to the viewer. The size and location of the vertical labeling area 15 and horizontal labeling area 12 can be varied to accommodate cards of varying dimensions.

Figure 6:
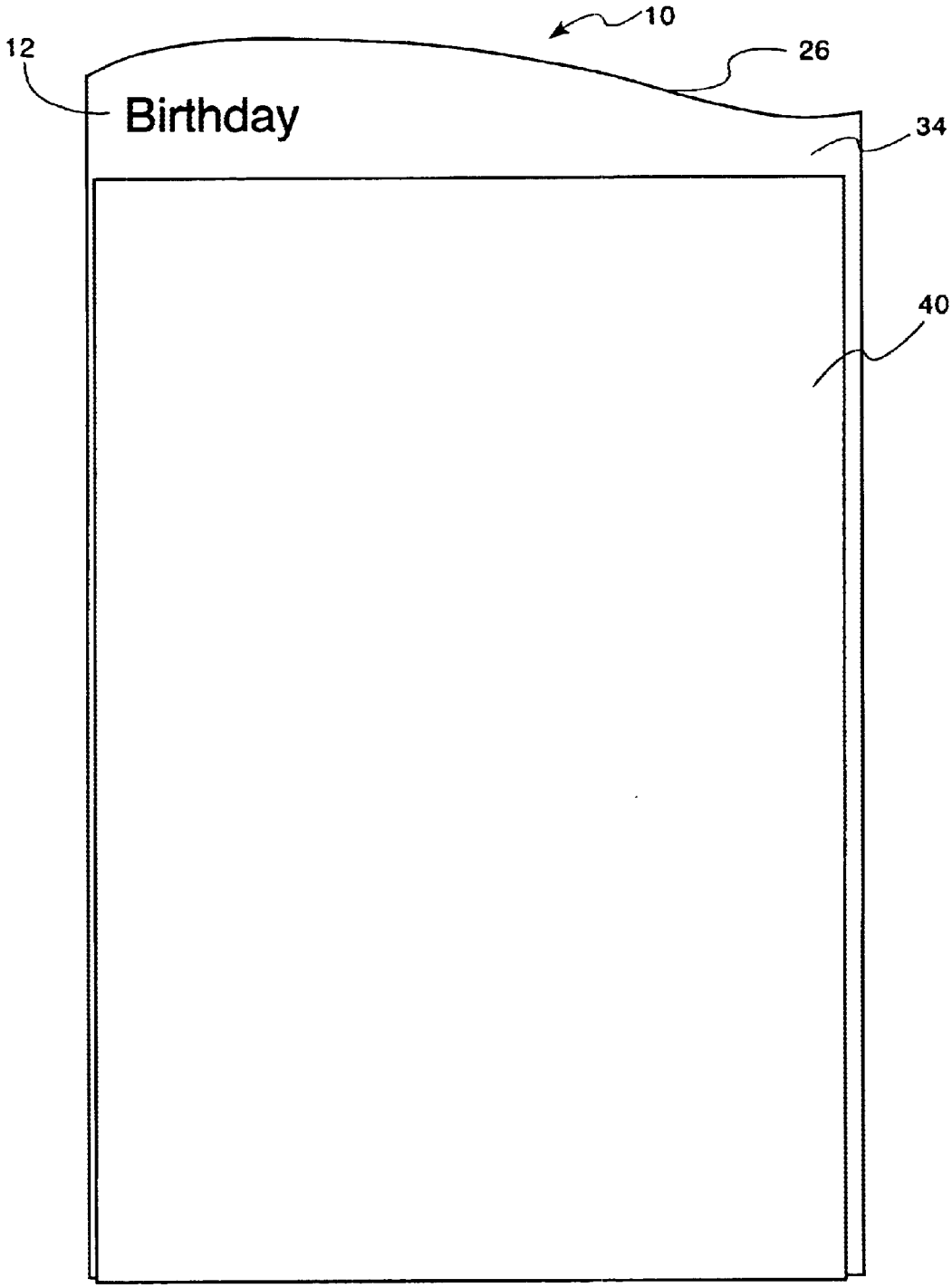
FIG. 6 is a front view of a mid-sized greeting card disposed in front of the PID of FIG. 1.

Turning now to FIG. 6, a PID 10 is disposed behind a card 40 of a median dimension. The card 40 obstructs the vertical labeling area 15, leaving visible the upper flap area 34, the horizontal label 12, and patterned edge 26. Optionally, a die cut area similar to that depicted in FIG. 2 may be implemented to provide an inclined base to cause the cards 40 to lean backward toward the PID 10 for optimal viewing.

Figure 7:
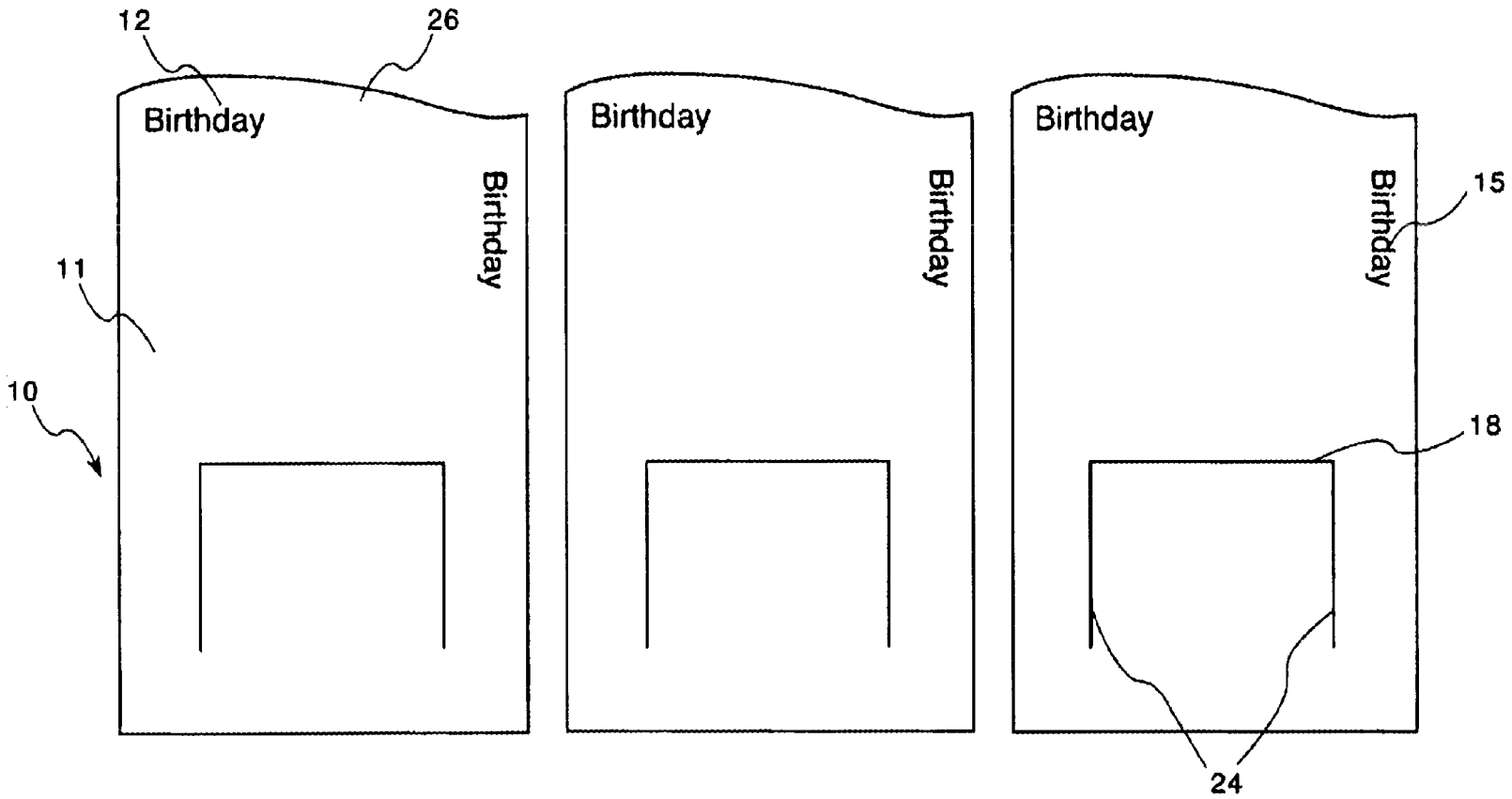
FIG. 7 is front view of three adjacently disposed PIDs.

FIG. 7 depicts the cooperation of the patterned edges 26 on adjacent PIDs. As installed, particularly in a rack-type display, the upper patterned edges together create a contiguous pattern that reduces visual clutter and increases viewer comprehension of the labels and the information and artwork included on cards 40. As noted above, the pattern 26 also increases visibility of cards disposed behind PID 10 by effecting the removal of unnecessary cardstock toward the right of horizontal label area 12. It will be readily appreciated that a wide variety of patterns can be implemented in accordance with the present invention. Triangular, dental, saw-tooth, arcuate, trapezoid, or other suitable linear or non-linear patterns can be used in connection with the display device of the instant invention to provide one or more of the foregoing advantages. As used herein, the term "non-linear" refers to a pattern comprising something other than a single straight line, and includes triangles or arcs.

The die cut areas, score lines, materials, and labels can each be modified to adapt the PID 10 for use with products of various configurations and weights. For instance, the die cut area defined by cut lines 18, 24 can repeated or repositioned on PID 10 to provide any desired vertical or lateral support, incline, decline, or folded flap configuration. For instance, vertical score lines and die-cuts may be included to provide a vertical flap area similar to flap area 34 in FIG. 3. As a further example, die cuts may be used to provide a vertically disposed shelf area similar to booster support 28, 30 shown in FIG. 2. Other configurations may be provided as needed in accordance with the teachings of the instant invention.

The aforementioned preferred embodiments have been described in the context of pocket identifier card, or PID.

However, as noted above, those skilled in the art will readily appreciate that the display device of the instant invention is not limited to use in a retail environment or in connection with greeting cards. Rather, in several of the aforementioned respects the device may be implemented in connection with the display or labeling of almost any product.

A number of embodiments of the present invention have been described. Nevertheless, it will be understood that various additional modifications may be made without departing from the spirit and scope of the invention. Accordingly, other embodiments are within the scope of the following claims.

What is claimed is:

1. An apparatus for displaying greeting cards, comprising:

a panel having a front face, a rear face, an upper edge, a lower edge, and a plurality of side edges, at least a substantial portion of said faces being substantially parallel to one another;

a booster portion having a perimeter entirely spaced in from the edges of said panel, wherein said booster portion having a perimeter entirely includes a plurality of foldable portions and is operable to support a greeting card in an elevated position relative to a lower edge of said panel;

a foldable portion proximate the upper edge defined by at least one fold line in said panel, which is capable of conforming said panel to a plurality of display units having different configurations; and a label on the foldable portion proximate the upper edge, wherein the label faces in the same direction as a face of the panel when foldable portion proximate the upper edge is in a folded condition.

2. The apparatus of claim 1, further comprising a plurality of foldable portions proximate the upper edge.

3. The apparatus of claim 1, wherein the booster portion is defined by one or more cut lines in said panel.

4. The apparatus of claim 1, wherein includes at least one of said edges has a non-linear pattern.

5. The apparatus of claim 1, wherein the panel retains its original height when the booster portion is in an operative position.

6. An apparatus for displaying cards, comprising:

a panel having a front face, a rear face, an upper edge, a lower edge, and a plurality of side edges, at least a substantial portion of said faces being substantially parallel to one another; and a booster portion spaced in from the edges of said panel;

wherein said booster portion includes a plurality of foldable portions and is operable to support a card in an elevated position relative to a lower edge of said panel.

7. The apparatus of claim 6, further comprising a foldable portion proximate the upper edge that includes a label.

8. The apparatus of claim 7, wherein the foldable portion proximate the upper edge is adapted to position the label in a plane other than the plane defined by the panel.

9. The apparatus of claim 6, wherein the foldable portion proximate the upper edge is capable of conforming the panel to display receptacles having a plurality of different configurations.

10. The apparatus of claim 6, wherein the booster portion is operable to conform the panel to greeting cards of varying dimensions such that upper edges of the adjacent greeting cards are substantially level within one another.

11. The apparatus of claim 6, wherein the panel includes at least one edge having a non-linear pattern.

12. The apparatus of claim 11, wherein the pattern on one panel cooperates with patterns on adjacent panels to form a continuous pattern.

13. The apparatus of claim 6, wherein the panel retains its original height when the booster portion is in an operative position.

14. An apparatus for displaying greeting cards, comprising:

a panel having a front face, a rear face, an upper edge, a lower edge, and a plurality of side edges at least a substantial portion of said faces being substantially parallel to one another;

a booster portion having a perimeter entirely spaced in from the edges of said panel, said booster portion including a plurality of foldable portions and being operable to support a card in an elevated position relative to a lower edge of said panel;

wherein the panel includes at least one edge having a non-linear pattern that cooperates with patterns on adjacent panels to form a continuous pattern.

15. The apparatus of claim 14, wherein the plurality of foldable portions are defined by at least one of a fold line or a cut line in said panel.

16. The apparatus of claim 15, further comprising a foldable portion proximate the upper edge that includes a label.

17. The apparatus of claim 16, wherein the foldable portion proximate the upper edge is adapted to position the label in a plane other than the plane defined by the panel.

18. The apparatus of claim 15, wherein the foldable portion proximate the upper edge is capable of conforming the panel to a plurality of display units having different dimensions.

19. The apparatus of claim 14, wherein the booster portion is capable of supporting cards of varying dimensions disposed adjacent and parallel to a face of the panel such that upper edges of the adjacent cards are substantially level within one another.

20. The apparatus of claim 14, wherein the panel retains its original height when the booster portion is in an operative position.

21. An apparatus for displaying greeting cards, comprising:

a panel having a front face and a rear face, at least a substantial portion of said faces being substantially parallel to one another;

a first label proximate and parallel to an upper edge of said panel;

a second label identical to the first label proximate and parallel to a side edge of said panel;

such that when cards of a first size are positioned adjacent the front face of the panel the second label is occluded and the first label is visible, and when cards of a second size are positioned adjacent the front face of the panel the first label is occluded and the second label is visible.

22. A method of using a greeting card display device, comprising the steps:

providing a panel having a front face, a rear face, an upper edge, a lower edge, and a plurality of side edges, at least a substantial portion, of said faces being substantially parallel to one another, and having a booster portion having a perimeter entirely spaced in from the edges of said panel and including a plurality of foldable portions, the booster portion being operable to support a card in an elevated position relative to a lower edge of said panel;

folding at least one foldable portion on said panel such that the panel is adapted to one of a plurality of different display units or card configurations; and installing the panel in the display unit.

23. An apparatus for displaying cards, comprising:

a panel having a front face and a rear face, at least a substantial portion of said faces being substantially parallel to one another; and a plurality of foldable portions defined by at least one of a fold line or a cut line in said panel;

wherein said foldable portions are capable of supporting a card disposed adjacent and parallel to a face of the panel, wherein the panel includes at least one edge having a non-linear pattern, and wherein the pattern on one panel cooperates with patterns on adjacent panels to form a continuous pattern.

24. An apparatus for use in a display unit, comprising:

a panel having a front face and a rear face, at least a substantial portion of said faces being substantially parallel to one another; and a plurality of foldable portions defined by at least one of a fold line or a cut line in said panel, wherein said foldable portions are capable of conforming said panel to a plurality of display units having different configurations, wherein the panel includes at least one edge having a non-linear pattern, and wherein the pattern on one panel cooperates with patterns on adjacent panels to form a continuous pattern.

* * * * *

UNITED STATES PATENT AND TRADEMARK OFFICE

CERTIFICATE OF CORRECTION

PATENT NO. : 6,612,052 B2
DATED : September 2, 2003
INVENTOR(S) : Beth A. Sawchuk It is certified that error appears in the above-identified patent and that said Letters Patent is hereby corrected as shown below:

Column 5,
Line 22, please delete "having a perimeter entirely"'
Line 39, please delete "includes";
Line 50, after "portion" please insert -- having a perimeter entirely --;

Column 6,
Line 13, after "edges" please insert -- , --;
Line 67, please delete ",".

Signed and Sealed this

Fourth Day of January, 2005

JON W. DUDAS
*Director of the United States Patent and Trademark Office*